US006070522A

United States Patent [19]

Koljonen

[11] Patent Number: 6,070,522

[45] Date of Patent: Jun. 6, 2000

[54] TRASH COMPACTOR

[76] Inventor: Reino Koljonen, 110-A3 Half Moon Cir., Lantana, Fla. 33462

[21] Appl. No.: 09/249,868

[22] Filed: Feb. 16, 1999

[51] Int. Cl.[7] ..... B30B 15/34; B30B 15/30

[52] U.S. Cl. ..... 100/74; 100/139; 100/215; 100/218; 100/233; 100/244; 100/318

[58] Field of Search ..... 100/90, 92, 73, 100/74, 100, 137–141, 177, 178, 215, 218, 233, 244, 302, 315–318, 320

[56] References Cited

U.S. PATENT DOCUMENTS

| | | | |
|---|---|---|---|
| 657,607 | 9/1900 | Luzatto | 100/74 |
| 965,298 | 7/1910 | Herbein | 100/317 |
| 1,054,464 | 2/1913 | Soucek | 100/317 |
| 1,183,760 | 5/1916 | Parker | 100/73 |
| 1,490,162 | 4/1924 | Dow | 100/317 |
| 2,817,891 | 12/1957 | Zweigle | 100/244 |
| 2,955,529 | 10/1960 | Marble | 100/244 |
| 3,075,456 | 1/1963 | Uschmann | 100/74 |
| 3,159,098 | 12/1964 | Dedekam et al. | 100/218 |
| 3,408,923 | 11/1968 | Bushmeyer | 100/218 |
| 3,521,553 | 7/1970 | Smolka et al. | 100/215 |
| 3,858,504 | 1/1975 | Boyer | 100/74 |
| 4,303,412 | 12/1981 | Baikoff | 100/244 |
| 5,060,452 | 10/1991 | Tabor | 100/244 |
| 5,666,878 | 9/1997 | Taricco | 100/317 |

*Primary Examiner*—Stephen F. Gerrity
*Attorney, Agent, or Firm*—Robert M. Downey, P.A.

[57] ABSTRACT

A transportable apparatus includes a housing with a door which opens to facilitate placement of trash within a trash receiving chamber of the apparatus. A sweep within the trash receiving chamber is actuated upon closing the door, forcing the deposited trash into a first compaction chamber, wherein the trash is mixed and compressed into a condensed mass by converging chamber walls and a downwardly directed spray of water released from high pressure nozzles at the top of the chamber. A reciprocating horizontal plate at the lower end of the first compaction chamber slices off a bottom layer of the mass of trash with each cycle of forward and rearward movement. The sliced layers of trash are pushed and compacted into a second compaction chamber until the second chamber is full. The trash is then compressed to form a composite unit of predetermined size and configuration. Electric discharge elements within the second chamber subject the compressed trash to an electrical charge, thereby removing moisture and causing the formed composite unit to become hardened. The composite unit is subsequently released from the second chamber and discharged from the housing.

15 Claims, 11 Drawing Sheets

TRASH COMPACTOR

BACKGROUND OF THE INVENTION

Field of the Invention

Description of the Related Art

As the world's population continues to increase, the disposal of trash has become an increasingly important concern. In more highly developed countries, where the population's consumption of goods is more significant, an average family disposes of over one ton of garbage every year. Household garbage consists primarily of paper from packaging, kitchen waste, glass, metals, plastics, fabrics, dust and miscellaneous refuse. Typically, these waste materials are mixed together from the time they are deposited into the kitchen trash container, and they remain commingled throughout the disposal process.

Presently, most of the world's garbage is dumped in landfills or burned in incinerators. The impact of landfill disposal and incineration on the environment has lead to a worldwide movement to encourage recycling of refuse materials. In particular, the recycling of paper, glass, metals, and plastics has increased significantly over the past 10 years. However, because recyclable materials from households, restaurants and industry are often commingled with other waste materials, they must first be separated before they can be recycled. The cost to separate materials for recycling is, in many instances, cost prohibitive. For this reason, most families are encouraged to separate their garbage at the time of disposal so that the various recyclable materials can be more easily processed and recycled. Unfortunately, due to the perceived inconvenience, it is difficult to achieve widespread compliance with this type of recycling plan.

Accordingly, in view of the worldwide problems and concerns associated with the disposal of garbage and other refuse materials, there is an urgent need for a more environmentally beneficial garbage disposal system. The present invention provides a means for disposing of garbage and recycling of refuse materials in a more efficient, cost-effective manner. More specifically, the present invention provides a trash compactor which reduces a load of commingled waste materials to one-tenth the original volume to produce a recycled product unit for use in the construction industry or other manufacturing industries.

SUMMARY OF THE INVENTION

The present invention is directed to a trash compactor apparatus and includes a housing for protectively surrounding and encapsulating interior components of the apparatus. Within the interior of the housing there is a trash receiving chamber, a first compaction assembly, and a second compaction assembly. A door on the housing opens to facilitate placement of trash within the trash receiving chamber. A sweep in the trash receiving chamber is actuated upon closing the door of the housing, forcing the deposited trash into a first compaction chamber of the first compaction assembly. Within the first compaction chamber, the trash is mixed and compressed into a condensed mass by converging chamber walls and a downwardly directed spray of water released from high pressure spray nozzles at the top of the chamber.

A reciprocating horizontal slide plate, driven by hydraulic cylinders, moves between a floor of the first compaction assembly and a slide surface. The bottom of the first compaction chamber is open so that the trash therein rests on the slide surface. A forwardly disposed, confronting face of the slide plate engages a lowermost layer of the mass of trash in the first compaction chamber, whereupon forward movement of the slide plate causes the lowermost layer of trash to be sliced off from the mass and pushed into a second compaction chamber of the second compaction assembly. The reciprocating slide plate continues to move sliced layers of the trash into the second compaction chamber until the second compaction chamber is full and packed tight with trash. The shape and configuration of the compacted mass of trash in the second compaction chamber assumes the shape of the chamber. Thus, the second compaction chamber can be structured to achieve the desired shape and configuration of the resultant compacted mass of trash. Once the second compaction chamber is filled, the compacted mass of trash is compressed and subjected to an electric charge, wherein the compacted mass acts as a semiconductor. The electric charge combined with pressure exerted on the compacted mass causes separation of hydrogen molecules from oxygen molecules, resulting in small explosions within the chamber and generation of hydrogen and oxygen gasses which are released through a valve assembly. This results in the removal of moisture from the trash and hardening of the mass to produce a composite material in the desired shape and configuration. The second compaction assembly is then lowered and a rear wall of the chamber is urged towards the open end of the second compaction chamber to remove the formed composite material outwardly from the second compaction chamber. A bin may be provided in a lower portion of the housing to accept the released composite units. Alternatively, a slide may be provided so that the composite units released from the second compaction chamber exit the housing.

It is intended that the formed composite units be used in various construction and manufacturing industries as a recycled material product. For instance, the composite units may be formed into boards or planks for use in the construction of walkways, boardwalks, docks, park benches, fences and the like.

With the foregoing in mind, it is a primary object of the present invention to provide a trash compactor apparatus which is structured and disposed to compact and treat trash, and to produce a recycled product.

It is a further object of the present invention to provide a trash compactor apparatus which is structured and disposed to accept commingled trash including, but not limited to, paper, packaging materials, wood, hospital waste, kitchen waste, glass, metals, plastics, paints, small rocks, fabrics, dust and other miscellaneous refuse, and to compact, treat and reduce the volume of the trash by ten times the original volume, yielding an integral composite recycled unit. It is still a further object of the present invention to provide a trash compactor apparatus which may be transported to various locations in order to provide a means for on-site disposal and treatment of garbage and other disposable refuse, thereby reducing the cost of garbage disposal.

It is still a further object of the present invention to provide a trash compactor apparatus which is adapted for use by restaurants, food processing facilities, and other commercial establishments to significantly reduce the cost of disposal of waste, garbage and other refuse materials.

It is still a further object of the present invention to provide a trash compactor apparatus which substantially reduces the harmful impact to the environment associated with waste disposal.

It is still a further object of the present invention to provide a trash compactor apparatus which is structured and disposed to convert trash into a recycled product for use in building and manufacturing industries.

These and other objects and advantages of the present invention will be more readily apparent with reference to the detailed description and drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
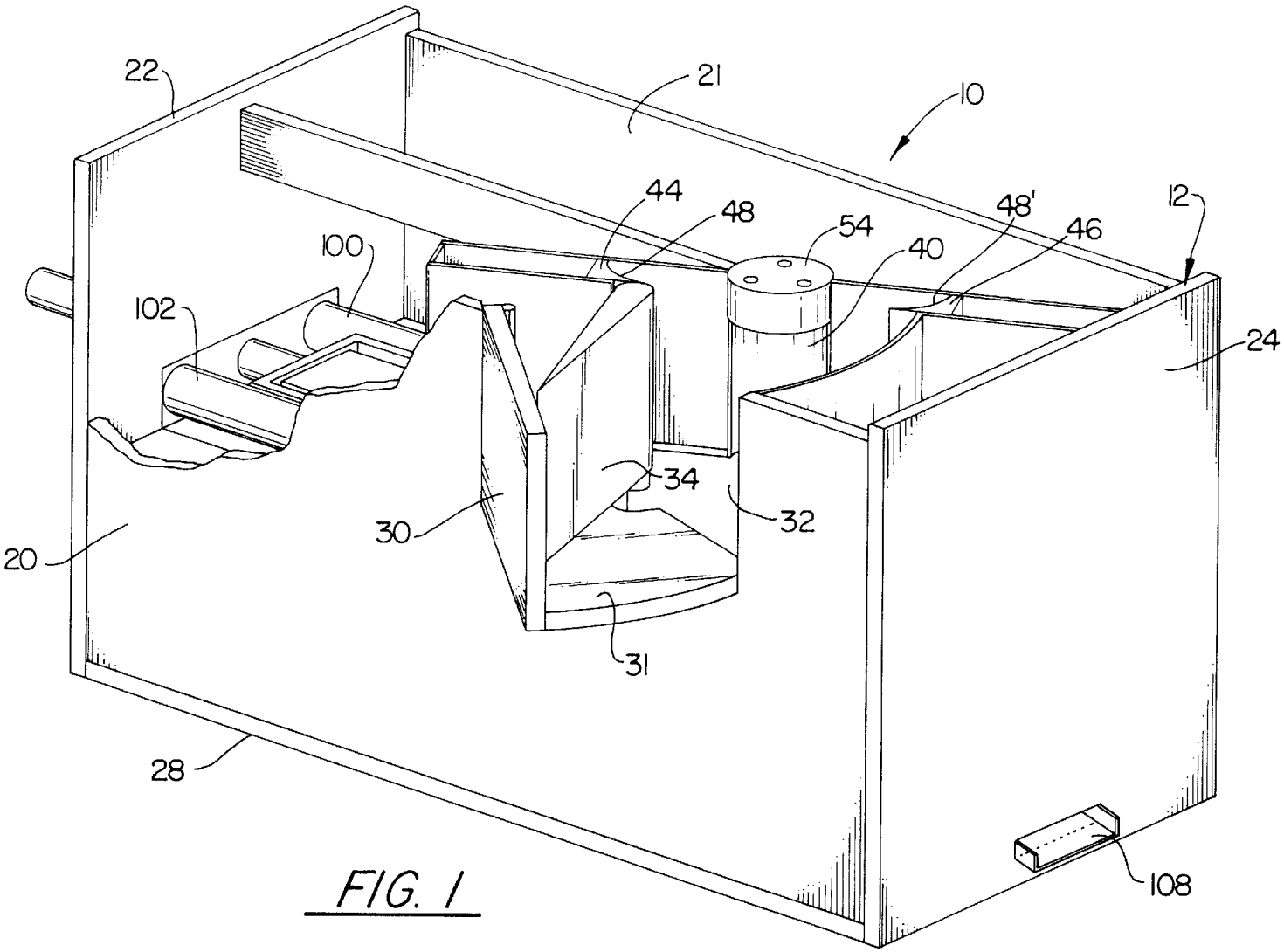
FIG. 1 is a top, side perspective view of the trash compactor apparatus, shown in partial cutaway.
Figure 2:
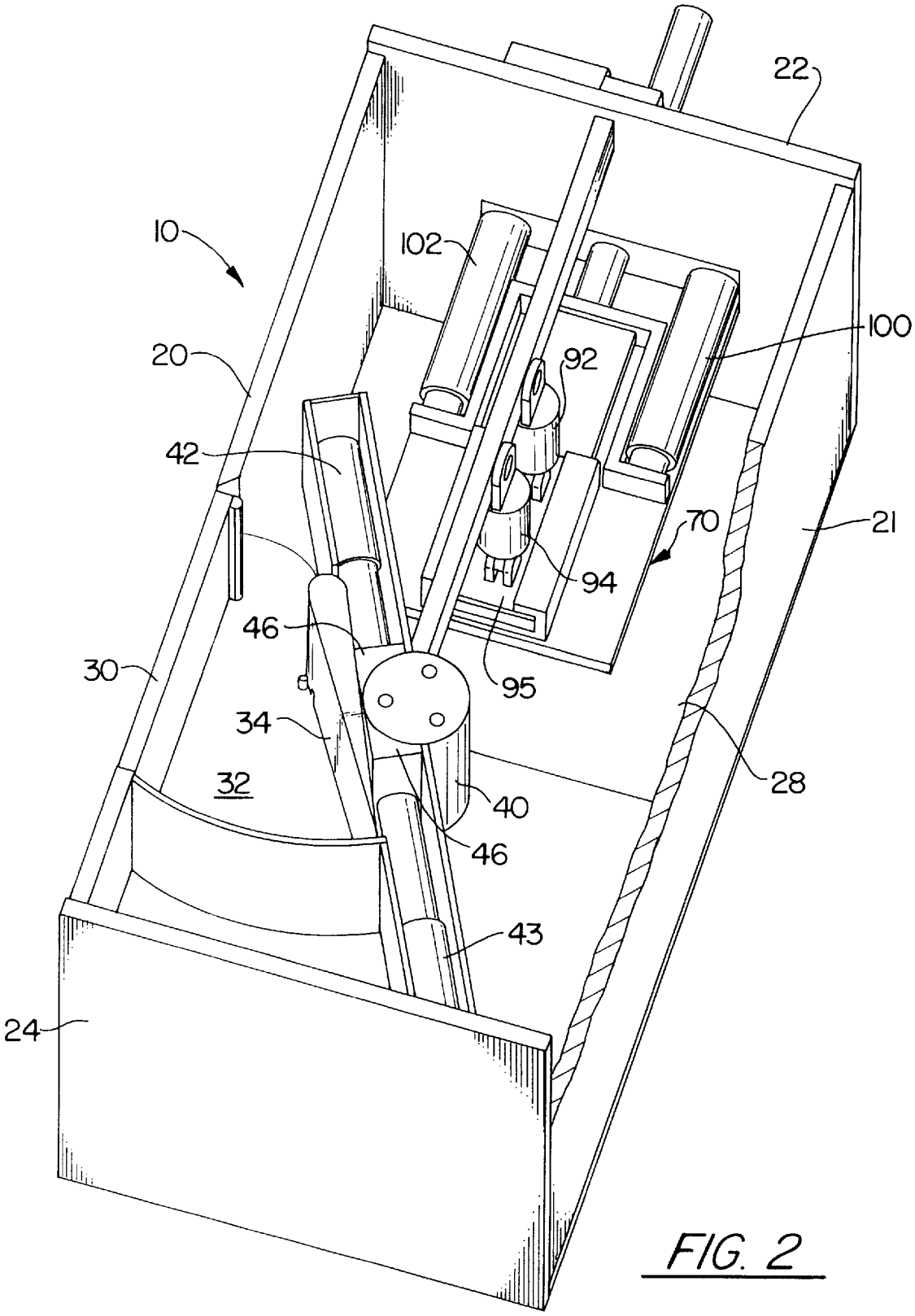
FIG. 2 is a top perspective view of the trash compactor apparatus shown in partial cutaway to reveal the interior component assemblies thereof.
Figure 10:
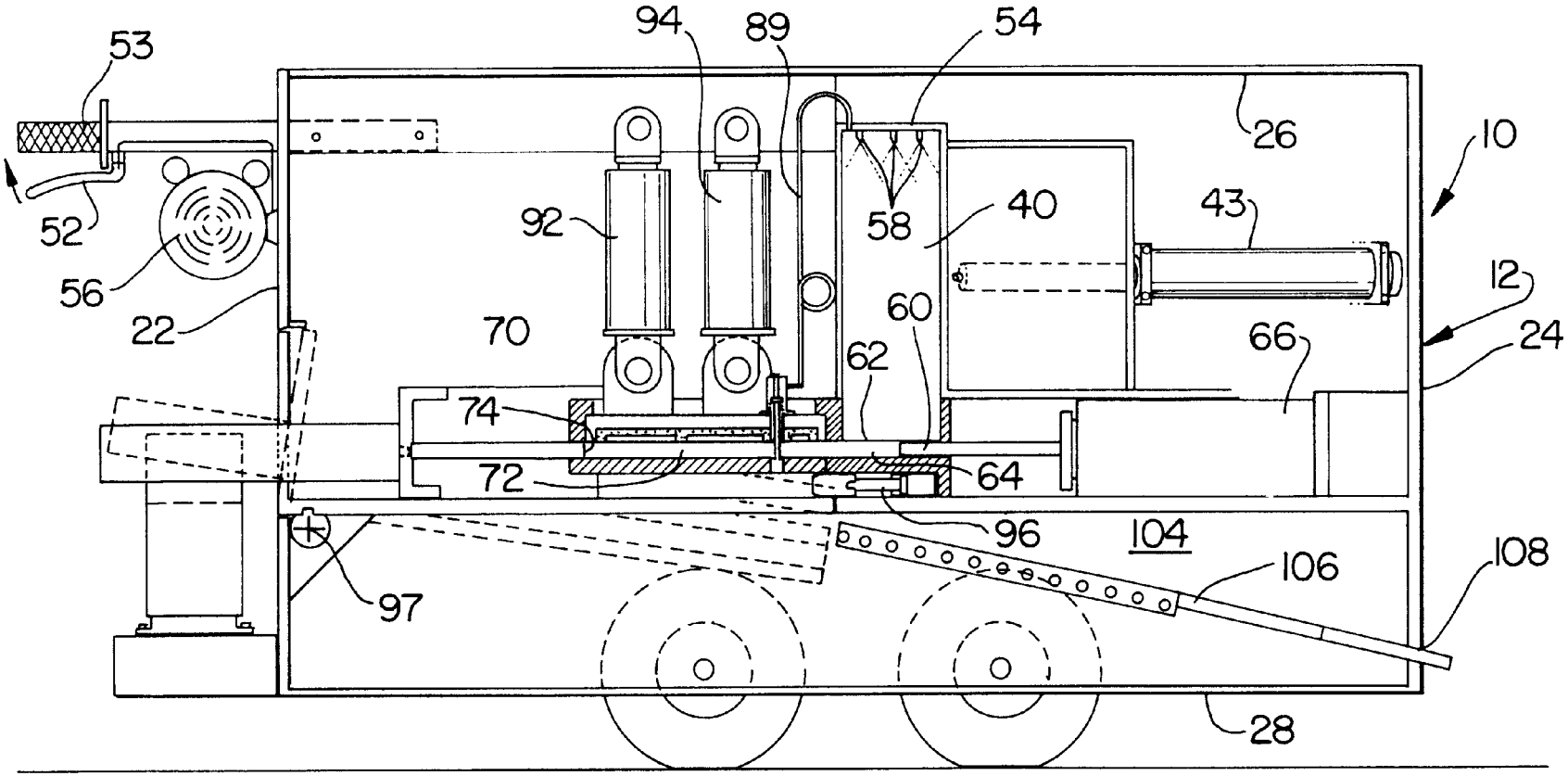
FIG. 10 is a side elevation of the apparatus showing a general schematic of the major components thereof.
Figure 11:
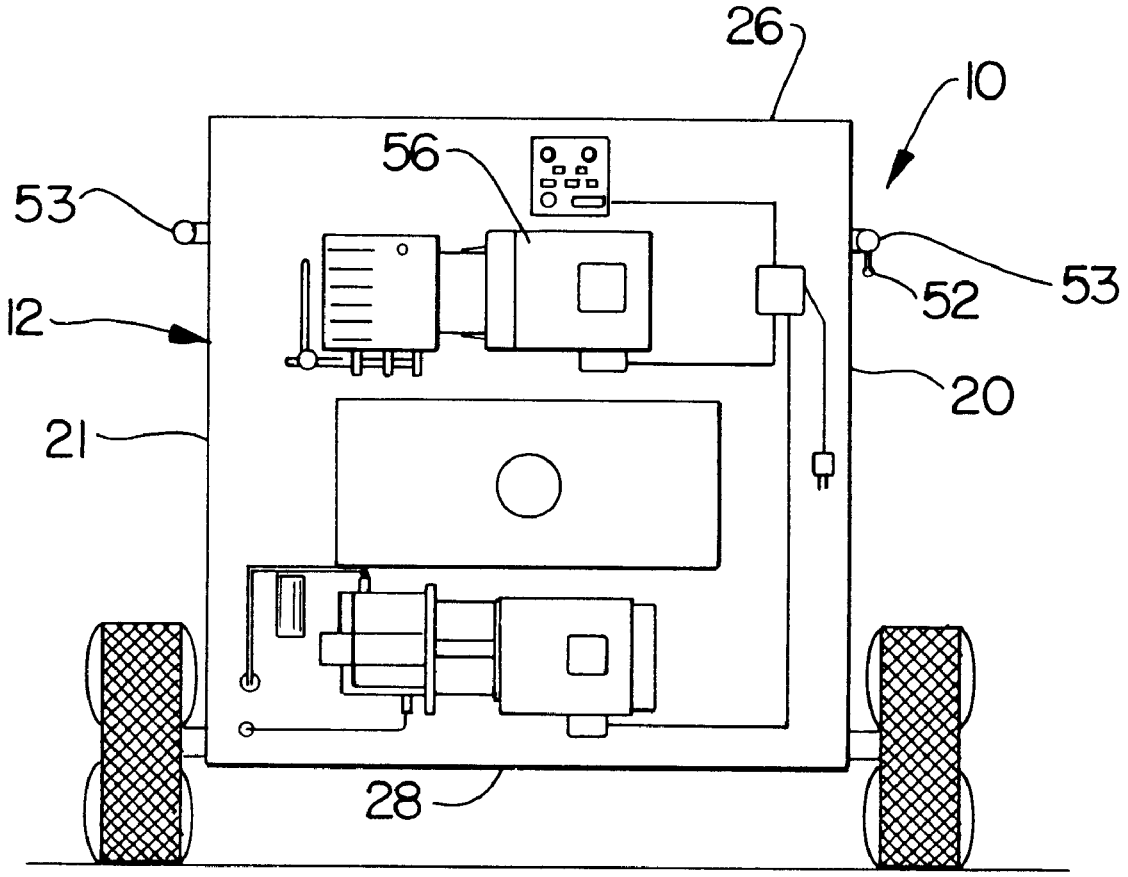
FIG. 11 is a front, exterior elevation of the apparatus.
Figure 12:
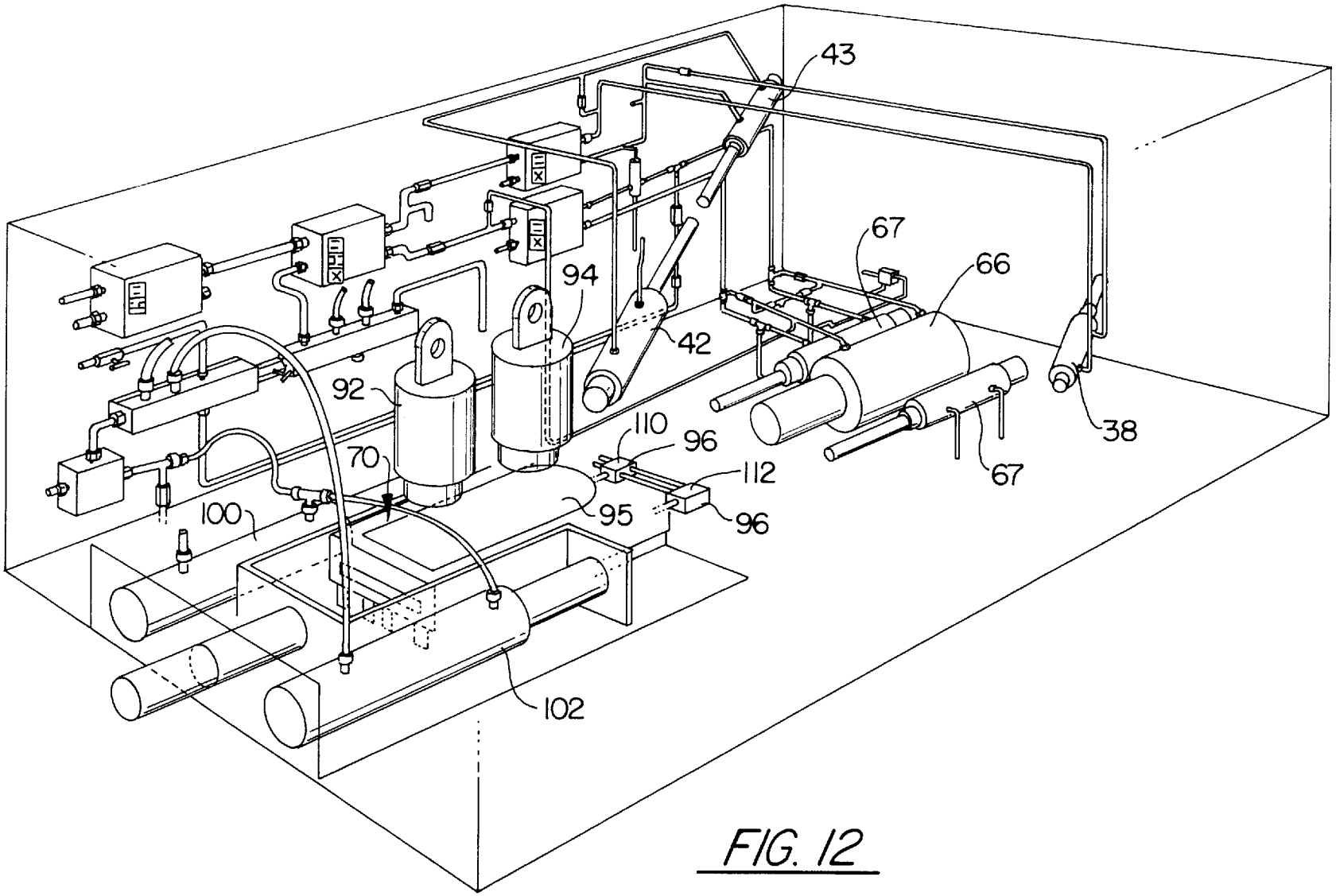
FIG. 12 is a system diagram, shown in perspective, illustrating the hydraulic system of the apparatus.

Referring initially to FIGS. 1, 10 and 11, the trash compactor apparatus 10 includes a housing 12 which may be supported on a plurality of wheels 14 to facilitate transport to locations of use. The housing 12 further includes side walls 20, 21, a front wall 22, a rear wall 24, a top 26 and a bottom 28 and is structured and disposed to protectively surround and encapsulate the primary moving components of the apparatus.

Figure 3:
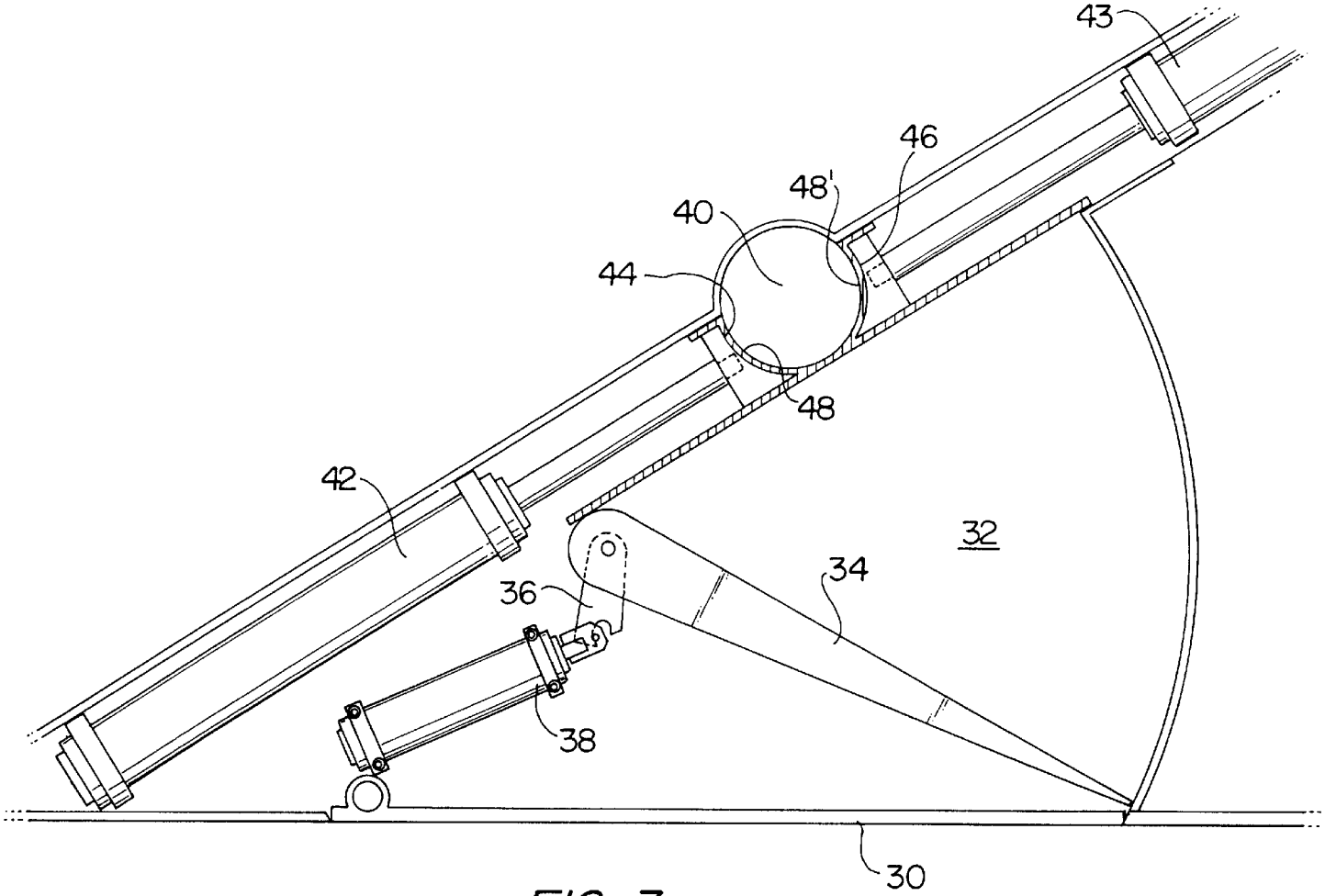
FIG. 3 is a top plan view of the receiving chamber and first compaction chamber.
Figure 4:
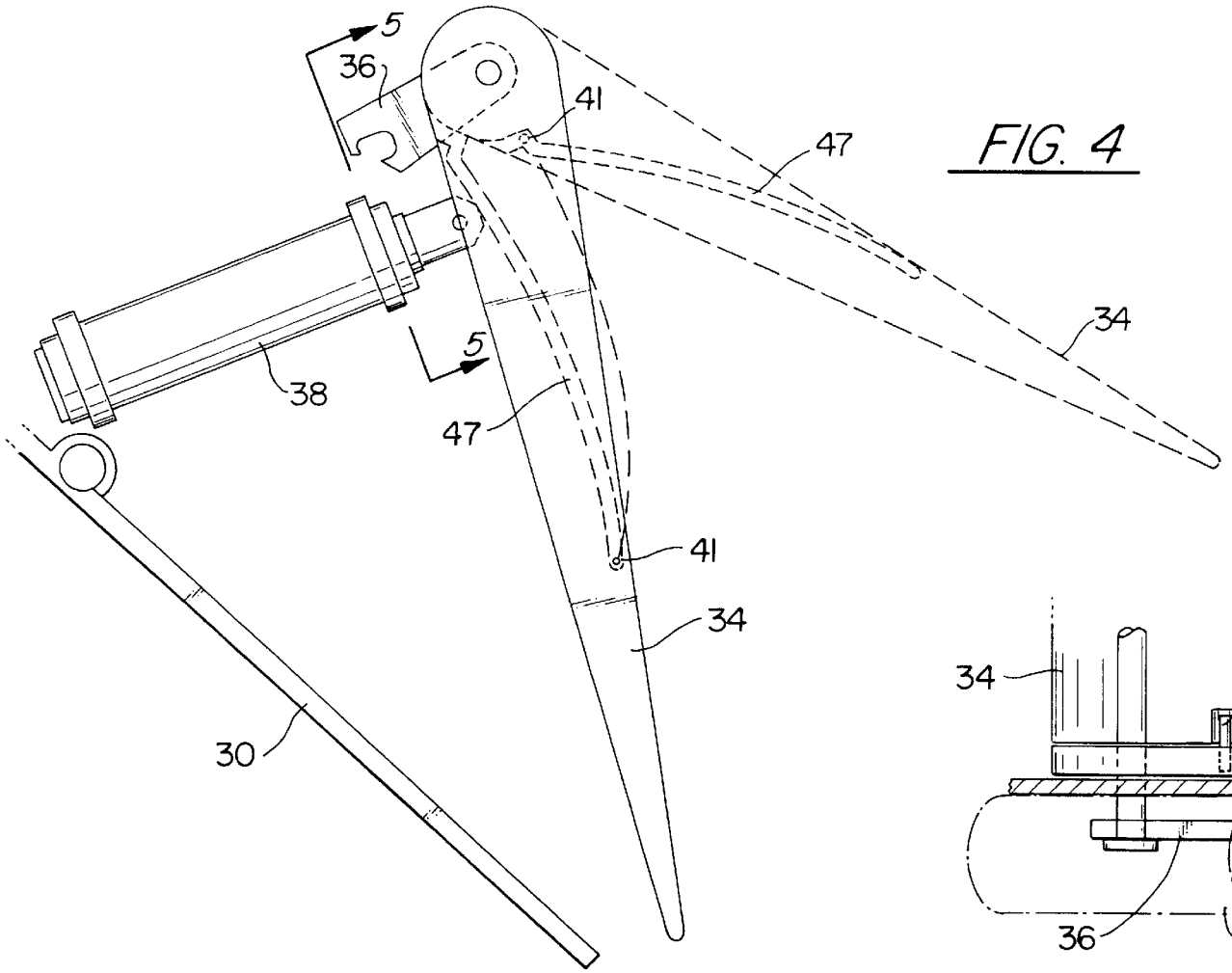
FIG. 4 is an isolated top plan view of the sweep and door assembly of the receiving chamber.
Figure 5:
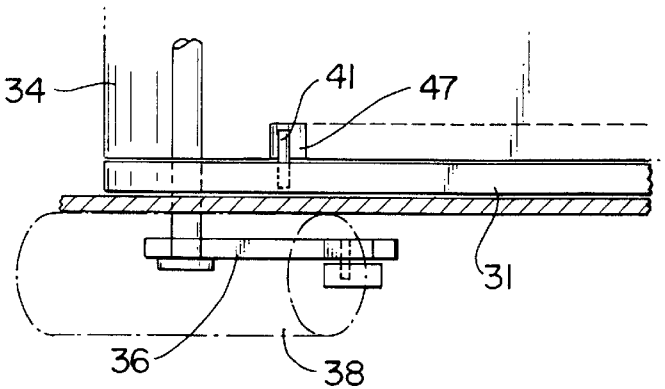
FIG. 5 is an isolated elevational view, shown in partial section, taken along the plane 5—5 of FIG. 4.
Figure 6:
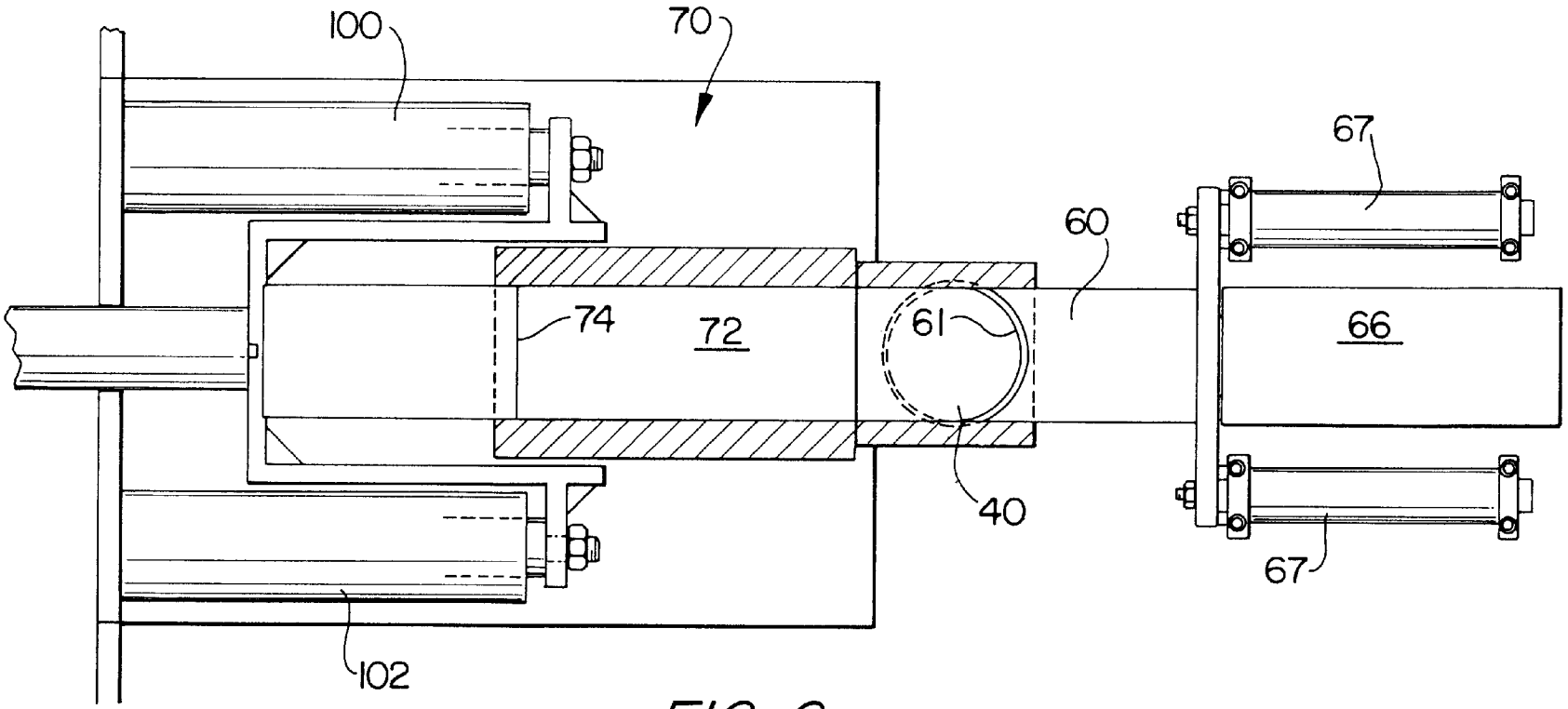
FIG. 6 is a top plan view of the slide plate assembly, shown in conjunction with the first and second compaction assemblies.
Figure 7A:
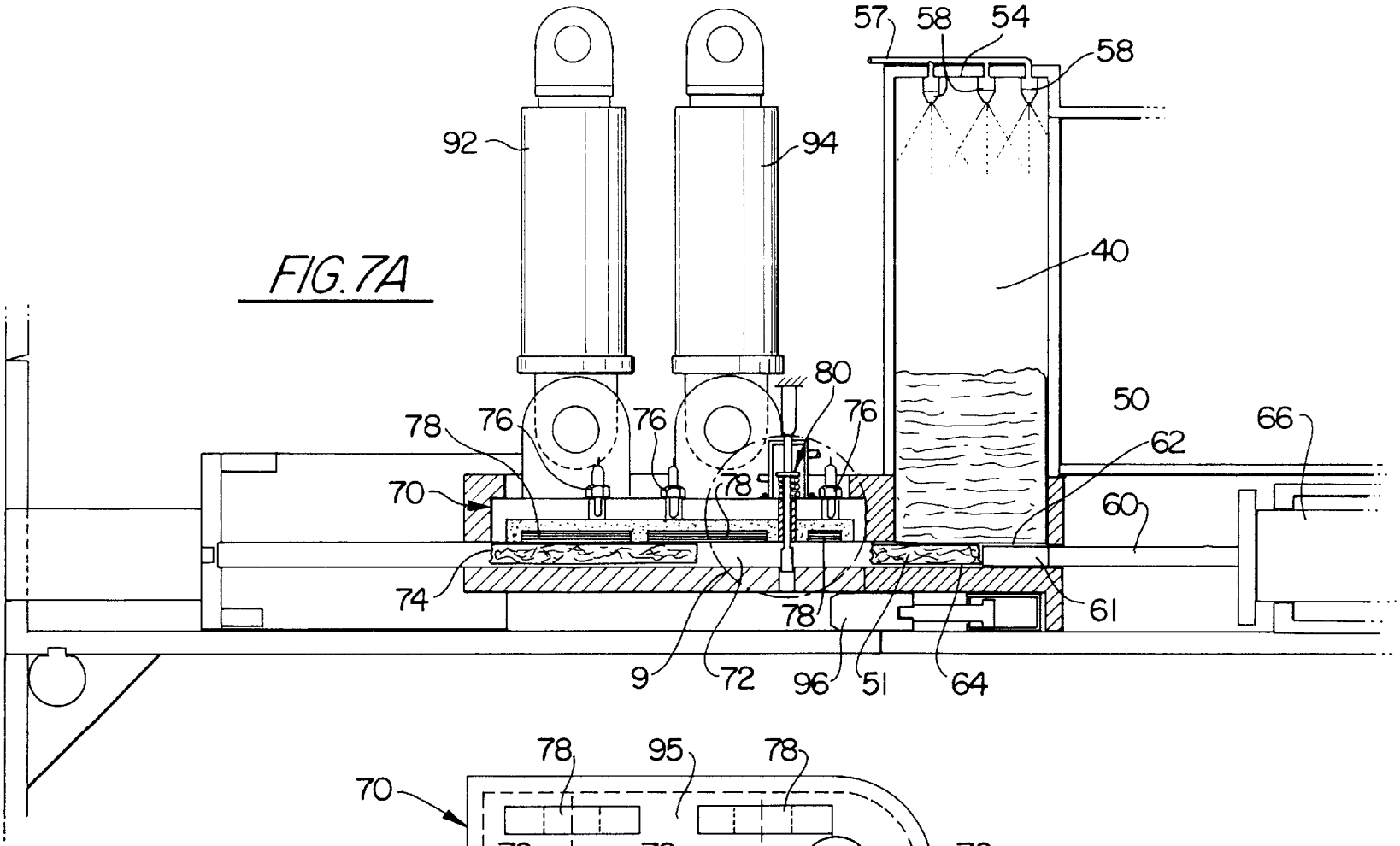
FIG. 7A is a side elevation, in partial section, showing the first and second compaction assemblies of the apparatus, with the second compaction assembly in a raised position for receiving trash from the first compaction assembly.
Figure 8:
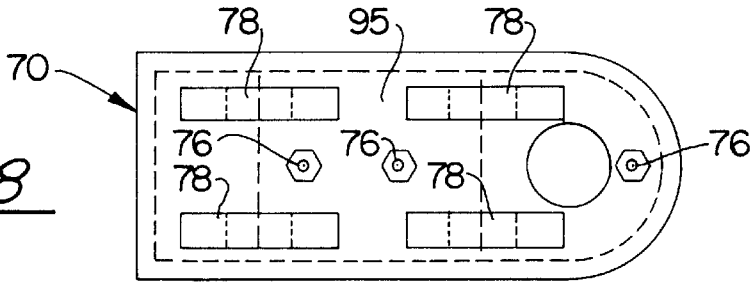
FIG. 8 is an isolated top plan view of the second compaction assembly.
Figure 7B:
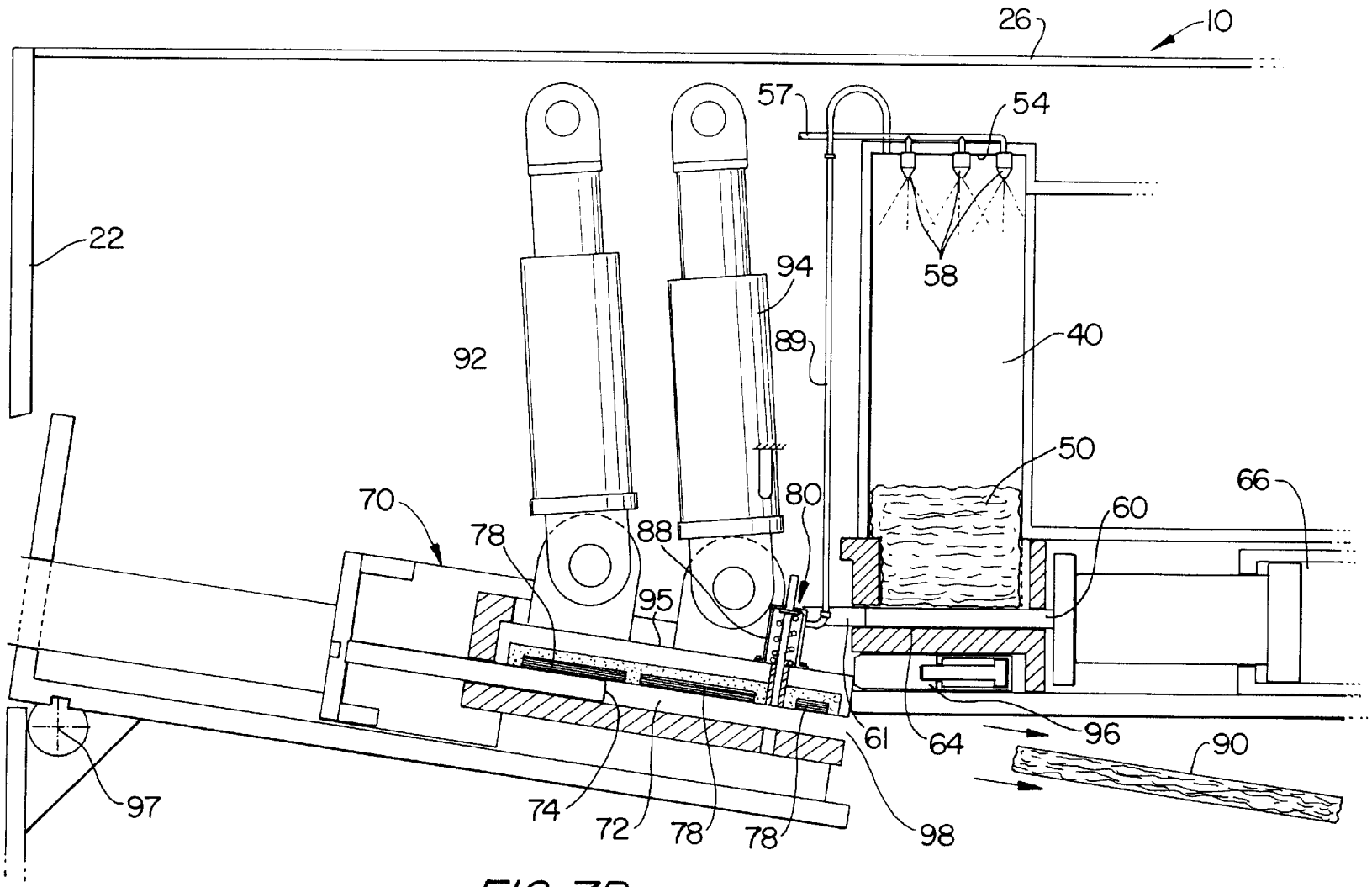
FIG. 7B is a side elevation, in partial section, showing the first and second compaction assemblies of the apparatus, with the second compaction assembly in a lowered position for dispensing the composite unit of compacted, treated trash.

A door 30 on the side of the housing includes a generally pie-shaped bottom plate 31 fixed thereto. The door 30 opens to facilitate deposit of trash within a trash receiving chamber 32. Upon closing the door, a sweep 34 is manually pushed through a partial sweeping motion until the door 30 is fully closed, at which point the door becomes engaged with a hydraulically driven closing mechanism 36. When the door is fully closed, a limit switch actuates a hydraulic cylinder 38 which, in conjunction with the closing mechanism 36, causes further movement of the sweep 34, pushing at least a portion of the trash into a first compaction treatment chamber 40. When the sweep 34 is moved to the position shown in FIG. 3, the door 30 can be opened. Upon opening the door 30, mechanism 36 disengages from driven engagement with the sweep to prevent hydraulic operation of the sweep while the door is open. Further, a pin 41 on the bottom plate 31 enters a curvlinear track 47 on the bottom of the sweep, pulling the sweep open with the door to thereby facilitate access to the receiving chamber 32. A pressure sensitive switch detects stop movement of the sweep when the first chamber 46 is filled with trash. Thereafter, hydraulic cylinders 42 and 43 are activated to close opposing chamber walls 44, 46 inwardly towards one another, causing the trash therein to be partially compacted and formed into a generally cylindrical mass 50. In the preferred embodiment, the inner opposing faces 48, 48' of the chamber walls are concave, as seen in FIGS. 1 and 3, so that when the walls are closed (as in FIG. 3), the chamber assumes a cylindrical configuration having a vertical central axis, compacting the mass 50 into a cylindrical shape. A manually operated trigger 52 on one of the exterior handles 53 of the apparatus operates a high pressure spray system, causing water to be sprayed downwardly from a ceiling 54 of the chamber 40 onto the trash therein. This mixes the trash while also adding moisture, enabling the trash to be more easily compacted into an integral package. The high pressure spray system, actuated by the trigger 52, includes a water pump 56 (shown on the exterior of the housing) which forces water through the conduit 57 leading to the plurality of spray nozzles 58 fitted to the ceiling of the first compaction chamber 40. In a preferred embodiment, the pump 56 is of a capacity sufficient to generate 1,000–1,500 psi of water pressure at the spray nozzles 58. The downward force of water spray serves to compress the mass 50 of trash down towards a bottom of the chamber 40.

Movement of the opposing chamber walls 44, 46 to a fully closed position triggers a limit switch which activates reciprocating motion of a horizontal slide plate 60 which moves in a forward and rearward cycle between a floor 62 of the first chamber 40 and a lower slide surface 64 which extends in spaced, parallel relation to the floor 62. Reciprocating motion of the horizontal slide plate 60 is driven by hydraulic cylinders, including a main cylinder 66 and augmenting cylinders 67. The floor of the chamber is open at the area directly below the compacted mass of trash, so that a lowermost portion 51 of the compacted mass 50 extends below the floor 62 and rests on the slide surface 64. Upon forward movement of the horizontal slide plate 60, the forwardly disposed face 61 of the slide plate engages the lowermost portion 51 of the mass 50 and slices off a layer (defining the lowermost portion). As the slide plate continues through a forward movement, the face 61 of the slide plate pushes the sliced layer into a second compression chamber 72 of a pivoting compaction assembly 70. Continued reciprocating motion of the horizontal slide plate delivers additional sliced layers of the mass of trash to the second compression chamber 72, causing the rear wall 74 of the second compression chamber to retreat under force, thereby continually enlarging the chamber. The rearward wall 74 exerts opposing pressure against the trash each time a new sliced layer is delivered and pushed into the second compression chamber by the slide plate, thereby horizontally compacting the trash therein.

Limit switches actuated upon movement of the rear wall activate electric charge elements 76, in sequence, which deliver electric current to electric discharge plates 78 within chamber 72 to subject the trash therein to electric charges. The combination of pressure and elective charges applied to the compacted trash creates a series of small explosions, releasing gasses, as hydrogen and oxygen molecules separate. This physical process results in the removal of moisture and hardening of the integral composite unit of trash 90.

Figure 9:
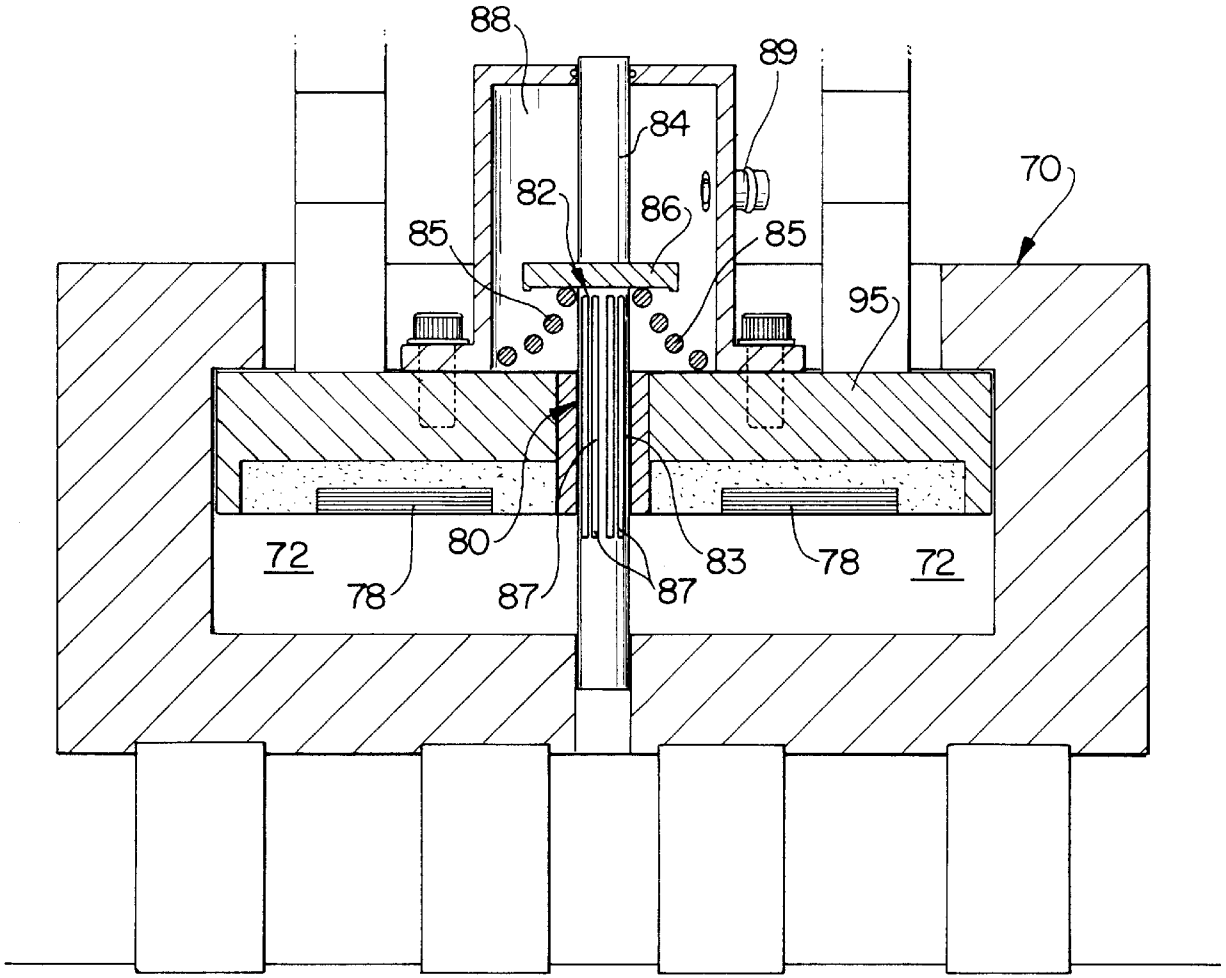
FIG. 9 is an isolated elevational view, shown in partial section, taken from the area indicated as 9 in FIG. 7A, showing a gas release valve assembly of the second compaction assembly.

The resultant gasses generated in the second compaction chamber 72 are released through a valve release assembly 80. The valve release assembly 80 is shown in detail in FIG. 9 and includes an elongate valve member 82 having a lower portion 83 and an upper portion 84. A spring element 85 engages a central flange 86 of the valve member 82 urging the valve member upwardly so that the lower portion 83 is normally in a raised position, above the interior of the second compression chamber 72. To release gasses within the second compression chamber, the valve member 82 is urged downwardly, against the spring element 85 so that the lower portion 83 extends through the interior of the compression chamber. The valve member includes elongate slots 87 formed about the lower portion 83 in air flow communication with a gas release chamber 88 above the second compression chamber. When the valve member urged downwardly, the gasses within the second compression chamber are directed to the gas release chamber 88 by traveling through the elongate slots 87 of the valve member and upwardly through the valve member to the gas release chamber. The gasses are directed from the gas release chamber 88 to the first compression chamber 40 through a hose 89.

When the rear wall 74 moves to a fully retreated position, indicating that the second chamber is filled, limit switches actuate hydraulic cylinders 92 and 94, causing the ceiling 95 of the second chamber 72 to be forced downward, thereby compressing the composite unit 90 of trash. Lock assemblies 96 are then actuated to release the pivoting compaction assembly 70 from a raised position and hydraulic cylinders 92 and 94 move the assembly about pivot axis 97 so that the end 98 of the second chamber 72 is moved down. Thereafter, cylinders 100 and 102 are activated to move the rear wall 74 towards the open end 98, causing the formed composite unit 90 of compacted trash to be pushed out from the second chamber and into a lower bin 104 in the housing 12. The housing may be fitted with a slide 106 so that the composite unit 90 exits the housing through opening 108 upon being deposited within the bin. Further, a conveyor system may be installed adjacent the housing to deliver the formed composite units of compacted trash to a remote location, such as a cart, truck, storage bin, etc.

Once the compacted unit 90 exits the second chamber 72, a limit switch deactivates cylinders 92 and 94, allowing springs in cylinders 92 and 94 to pull the entire pivoting assembly 70 upwardly to the first operable position so that the open end 98 of the second chamber is disposed in horizontally aligned, trash receiving communication with the horizontal slide plate 60 and the bottom of the first chamber 40. Thereafter, limit switches are actuated to activate cylinders 110 and 112, causing the lock assemblies 96 to be closed and thereby holding the compaction assembly 70 in the upright position. At this stage, the above-described cycle is repeated, until all trash in the apparatus has been compacted and discharged.

While the instant invention has been described and illustrated in what is considered to be a preferred and practical embodiment thereof, it is recognized that departures may be made within the spirit and scope of the invention, as set forth in the following claims, the limitations of which shall be determined under the doctrine of equivalents.

What is claimed is:

1. An apparatus for compacting trash comprising:

receiving means for receiving trash to be compacted by said apparatus;

a first compaction assembly for compacting the trash to form a first compacted mass;

said receiving means including a trash receiving chamber comprising:

sweep means for moving the trash from said trash receiving chamber into said first compaction assembly; and means for drivingly engaging said sweep means to move said sweep means between a first position and a second position, to thereby move the trash to said first compaction assembly;

a second compaction assembly for further compacting said mass of compacted trash to form a composite unit and said second compaction assembly including means for removing moisture from said composite unit and for hardening said composite unit;

means for moving the trash from said first compaction assembly to said second compaction assembly and including slide means for removing a portion of said first compacted mass of trash within said first compaction assembly and moving said portion of said first compacted mass to said second compaction assembly; and means for removing said hardened composite unit from said second compaction assembly.

2. An apparatus as recited in claim 1 wherein said first compaction assembly further includes spray means for mixing, softening, compressing and adding moisture to the trash in said first compaction chamber.

3. An apparatus as recited in claim 1 wherein the means for removing moisture further comprises electric discharge means for applying an electric charge to said composite unit for removing moisture and for hardening said composite unit.

4. An apparatus as recited in claim 1 wherein said second compaction assembly further comprises means for forming said composite unit into a predetermined size and configuration.

5. An apparatus for compacting trash comprising:

a housing protectively surrounding and encapsulating a trash receiving chamber, a first compaction assembly and a second compaction assembly;

access means on said housing to facilitate placement of trash within said trash receiving chamber;

said trash receiving chamber including:

sweep means for moving the trash from said trash receiving chamber into said first compaction assembly; and means for drivingly engaging said sweep means to move said sweep means between a first position and a second position, to thereby move the trash to said first compaction assembly;

said first compaction assembly including a first compaction chamber disposed in communication with said trash receiving chamber and being structured and disposed to accept the trash moved by said sweep means;

said first compaction assembly further including spray means for mixing, softening, compressing and adding moisture to the trash in said first compaction chamber;

said first compaction assembly further including means for compacting the trash within said first compaction chamber to form a condensed mass; chamber;

slide means for moving at least a portion of said condensed mass of trash from said first compaction chamber to said second compaction assembly;

said second compaction assembly including a second compaction chamber structured and disposed to receive the condensed mass of trash by said slide means;

said second compaction assembly including means for compressing the trash within said second compaction chamber to form a composite unit of predetermined size and configuration;

said second compaction assembly further including electric discharge means for applying an electric charge to said composite unit for removing moisture and hardening said composite unit;

means for moving said second compaction assembly between a normally raised position and a lowered position;

means for removing said composite unit from said second compaction chamber when said second compaction assembly is moved to said lowered position; and means for dispensing said composite unit from said housing.

6. An apparatus as recited in claim 5 wherein said access means on said housing includes a door movable between an open and closed position.

7. An apparatus as recited in claim 6 wherein said spray means includes pressure spray means for spraying water at high pressure and including a plurality of spray nozzles positioned and disposed at an upper portion of said first compaction chamber, said plurality of nozzles being structured and disposed to disperse a sprayed array of water downwardly onto the trash in said first compaction chamber.

8. An apparatus as recited in claim 7 wherein said pressure spray assembly is structured to release water from said plurality of nozzles at a pressure of at least 1,000 psi.

9. An apparatus as recited in claim 7 wherein said means for compacting the trash within said first compaction chamber includes opposing chamber wall portions movable in relation to said first compaction chamber between a first position and a second position, wherein movement from said first position to said second position is defined by said chamber wall portions converging towards one another to thereby compact the trash within said first compaction chamber.

10. An apparatus as recited in claim 9 wherein said slide means includes a slide plate movable in a reciprocating, horizontal motion in relation at a lowermost portion of said first compaction chamber, said slide plate including a forward face structured and disposed to engage a lowermost portion of said condensed mass of trash in said first compaction chamber and to slice a lowermost layer of trash from said condensed mass, pushing said sliced layer into said second compaction chamber.

11. An apparatus as recited in claim 10 wherein said means for compressing the trash includes an upper portion of said second compaction chamber being movable in response to a downward force exerted thereon, thereby reducing an interior volume of said second compaction chamber and exerting a downward compressing force on the trash therein.

12. An apparatus as recited in claim 11 wherein said electric discharge means includes a plurality of electric discharge elements fitted to said second compaction chamber in electrical communication with the trash within said second compaction chamber.

13. An apparatus as recited in claim 12 wherein said means for removing said composite unit from said second compaction chamber includes a rear wall of said second compaction chamber being movable along a length of said second compaction chamber between a first end and an opposite open end thereof.

14. An apparatus as recited in claim 5 further including gas release valve means for releasing gasses generated within said second compaction chamber.

15. An apparatus for compacting trash comprising:

receiving means for receiving trash to be compacted by said apparatus;

a first compaction assembly for compacting the trash to form a first compacted mass;

said receiving means including a trash receiving chamber comprising:

sweep means for moving the trash from said trash receiving chamber into said first compaction assembly; and means for drivingly engaging said sweep means to move said sweep means between a first position and a second position, to thereby move the trash to said first compaction assembly;

said first compaction assembly further including spray means for mixing, softening, compressing and adding moisture to the trash in said first compaction chamber;

a second compaction assembly for further compacting said mass of compacted trash to form a composite unit and said second compaction assembly including means for removing moisture from said composite unit and for hardening said composite unit;

means for moving the trash from said first compaction assembly to said second compaction assembly and including slide means for removing a portion of said first compacted mass of trash within said first compaction assembly and moving said portion of said first compacted mass to said second compaction assembly; and means for removing said hardened composite unit from said second compaction assembly.

* * * * *